United States Patent [19]

Isley

[11] 3,969,967

[45] July 20, 1976

[54] WOOD TRIMMING MACHINE

[76] Inventor: Reggald E. Isley, 8504 100th A St., Grande Prairie, Alberta, Canada

[22] Filed: Oct. 16, 1975

[21] Appl. No.: 623,162

[30] Foreign Application Priority Data

Oct. 24, 1974 Canada ..... 212218

[52] U.S. Cl. ..... 83/435.2; 83/269; 83/467 R

[51] Int. Cl.[2] ..... B27B 5/29

[58] Field of Search ..... 83/268, 269, 467, 732, 83/435.2

[56] References Cited

UNITED STATES PATENTS 2,253,453 8/1941 Van Deinse ..... 83/435.2 X

*Primary Examiner*—Willie G. Abercrombie

[57] ABSTRACT

Apparatus is provided having a series of aligned swinging stops to simplify the operation of cutting unwanted end portions off lumber which moves generally sideways through the apparatus. The swinging stops can be used individually to locate an end of the lumber before cutting the lumber. Also any particular stop can swing out of the path of the lumber if the lumber is engaged against another stop. Each swinging stop has a first portion extending generally downwardly from a pivotal mounting for arcuate movement along a path aligned with the direction of travel of the lumber through the apparatus, and a second portion pivotally connected to the first portion below the pivotal mounting for movement in another arcuate path which is also aligned with the direction of travel of the lumber. The second portion has a distal end which is engaged by the lumber when the swinging stop is to move out of the path of the lumber and tends to return to its original position quickly for engagement by a succeeding length of lumber.

5 Claims, 6 Drawing Figures

WOOD TRIMMING MACHINE

This invention relates to apparatus for cutting unwanted end portions off lumber in the form of planks, studs and the like such that each of the remaining pieces of lumber is in one of several preferred lengths.

When the lumber is cut and dressed in preferred cross sections to form planks, studs and the like, it is not uncommon that the lumber includes split or otherwise unacceptable end portions. The cost of lumber makes it worthwhile to trim unwanted end portions off the lumber. However, the remaining piece of lumber should be in one of several preferred lengths because lumber is normally purchased in such lengths. Consequently it has become common practice to use a jig or fixture in association with a bench saw to trim lumber into one of the preferred lengths.

It is an object of the present invention to provide an improved apparatus which can be used to more efficiently trim unwanted end portions off lumber in the form of planks, studs and the like leaving pieces of the lumber in preferred lengths.

It has been found that apparatus having a series of aligned swinging stops simplifies the operation of cutting unwanted end portions off lumber which moves generally sideways through the apparatus. The swinging stops can be used individually to locate an end of the lumber before cutting the lumber. Also any particular stop can swing out of the path of the lumber if the lumber is engaged against another stop. Each swinging stop has a first portion extending generally downwardly from a pivotal mounting for arcuate movement along a path aligned with the direction of travel of the lumber through the apparatus, and a second portion pivotally connected to the first portion below the pivotal mounting for movement in another arcuate path which is also aligned with the direction of travel of the lumber. The second portion has a distal end which is engaged by the lumber when the swinging stop is to move out of the path of the lumber and tends to return to its original position quickly for engagement by a succeeding length of lumber.

The invention will be better understood with reference to the drawings, in which.

References are made initially to FIGS. 1 and 2 to initially describe the principle of operation of the apparatus and subsequently to describe the apparatus in more detail.

Figure 2:
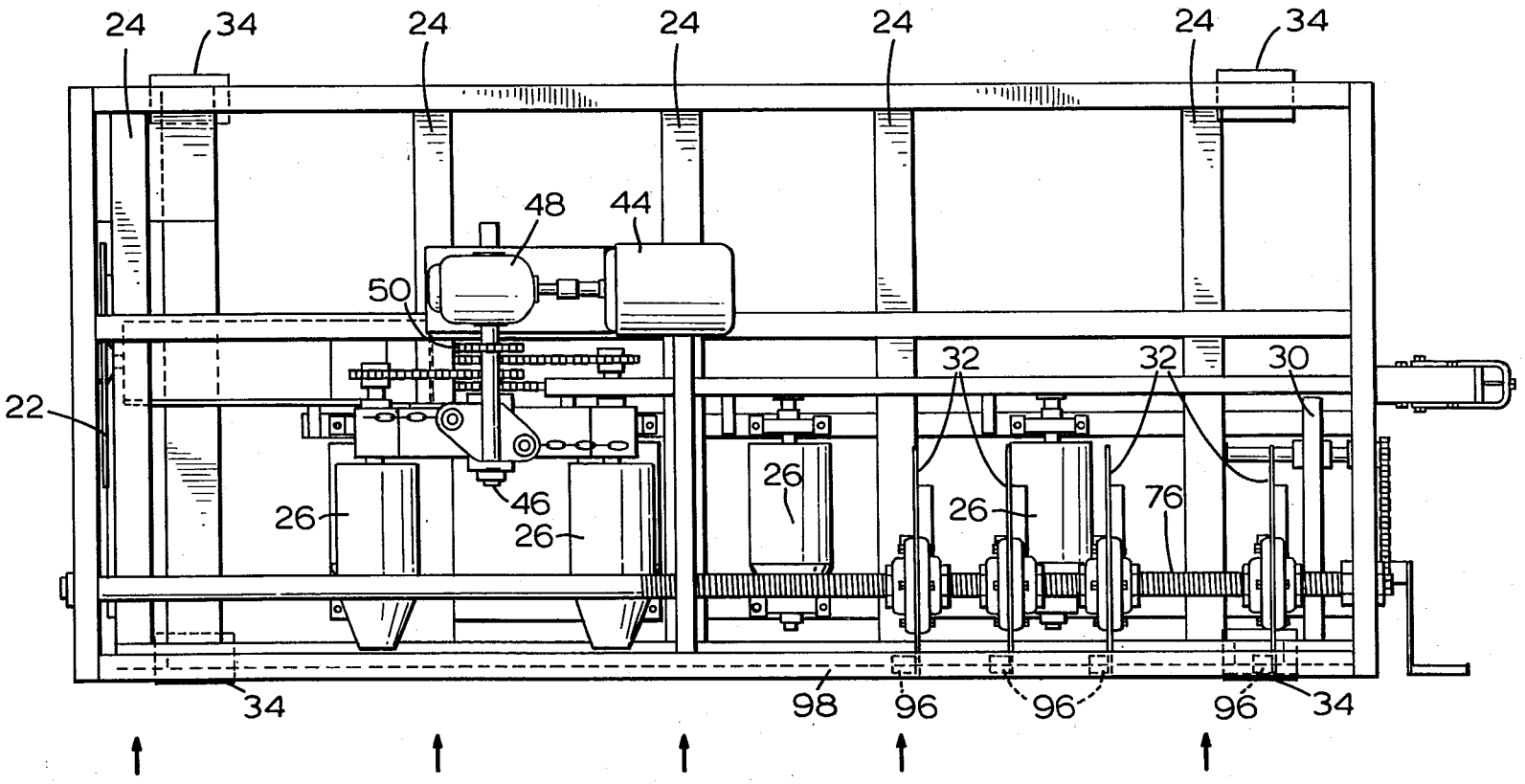
FIG. 2 is a top view of the apparatus.

Lumber is fed sideways onto the apparatus in the direction of the arrows at the foot of FIG. 2 from a table or other suitable supply device. Before the lumber meets the apparatus, an operator moves the lumber lengthwise so that any unwanted end portion overhangs a framework 20 of the apparatus adjacent a saw 22. As the lumber enters the apparatus it is picked up by five parallel conveyors 24 which have low profile upstanding lugs for pushing the lumber forwardly. These lugs will be described with reference to FIG. 3. As the lumber moves forwardly it is driven by the lugs up conical end portions of four lower rollers 26 lying with their axes in the direction of movement of the lumber. These rollers combine with a drive mechanism 28 to drive the lumber lengthwise towards an adjustable end stop 30 while the lumber remains in contact with the lugs of conveyors 24. However, in the event that one of four swinging stops 32 lies between an end of the lumber and the end stop 30 then the lumber will meet this swinging stop and be located lengthwise by it. The lumber will then continue its sideways path driven by the conveyors 24 and be trimmed by the saw 22 into a length dictated by the distance between the saw and the stop which the lumber engaged. It will therefore be evident that if the swinging stops 32 are located in preferred positions, the lumber can be cut only in corresponding preferred lengths.

The apparatus will now be described in more detail. The framework 20 includes four legs 34 supporting a lower structure indicated generally by the numeral 36. This structure is spaced below an upper structure indicated generally by the numeral 38 and connected to the lower structure by end structures 40, 42. The lower structure 36 supports the conveyors 24 which are driven conventionally in unison by any suitable drive mechanism. The lower rollers 26 are also supported from the structure 36 with their axes parallel to the direction of motion of the conveyors 24.

Drive mechanism 28 consists of a motor 44 which drives a shaft 46 through a gear box 48. This shaft is connected downwardly by a chain 50 to a layshaft 52 on the upper structure 38. The lay shaft 52 has sprockets coupled to it for driving chains 54, 56, and 58 as well as a sprocket transmitting drive from the chain 50. The chains 54, 56 extend generally downwardly and away from one another for transmitting drive to respective pinch rollers 60, 62 mounted at the ends of swing arms 64, 66. These arms are free to rotate about the axis of the layshaft 52 so that their weight brings the pinch rollers into contact with the lumber. Respective suspension members 68, 70 depend from a bracket 72 to limit downward movement of the arms 64, 66.

Figure 1:
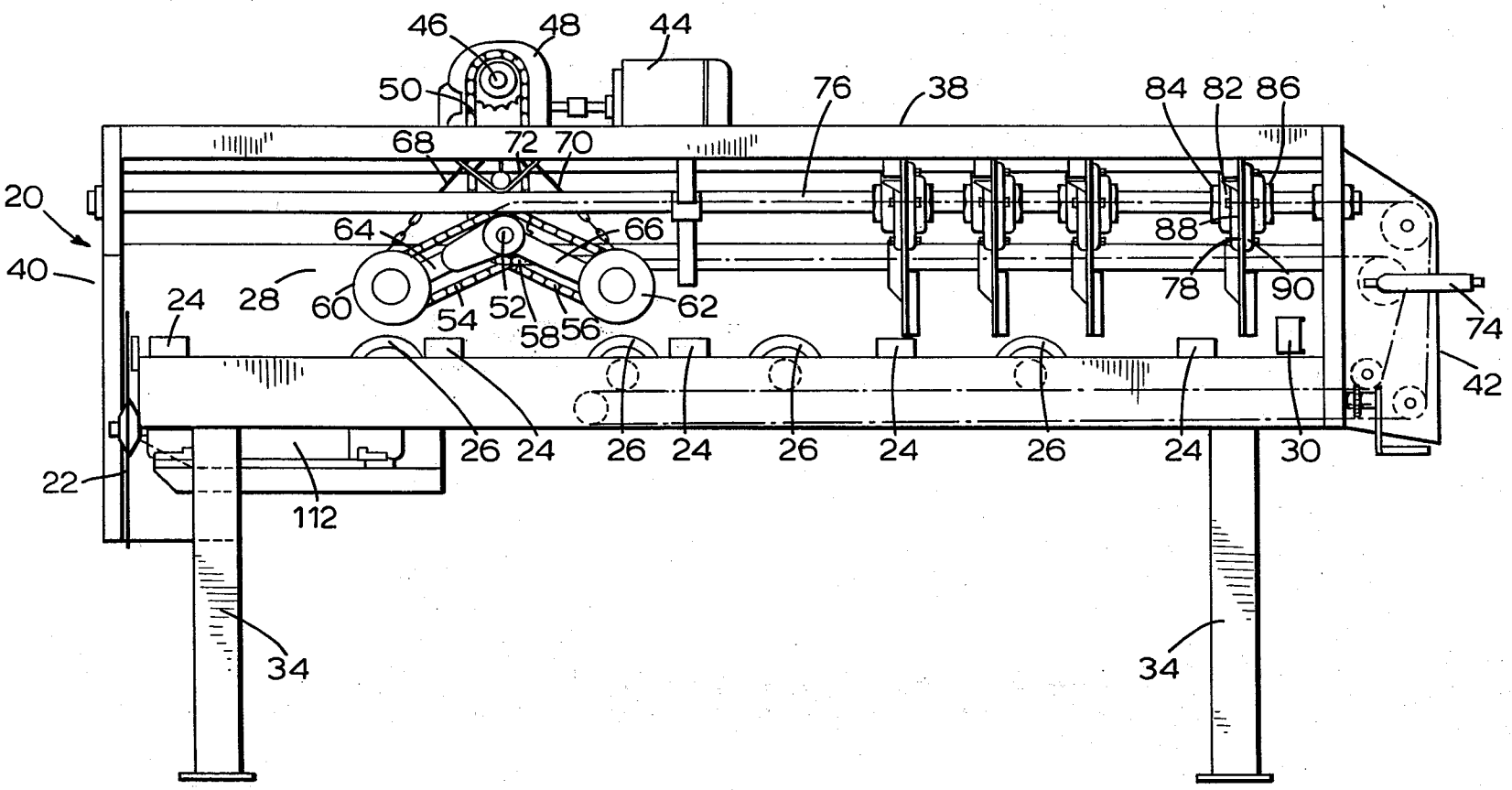
FIG. 1 is a front view of a preferred embodiment of apparatus incorporating the invention.

The rollers 60, 62 are driven to rotate in a counterclockwise direction as shown in FIG. 1 to move lumber towards the end stop 30. Similarly, at least some of the lower rollers 26 are driven from the motor 44 by a chain 58 which extends through the end structure 42 and the lower structure 36 to drive three of the lower rollers 26. A chain tensioner 74 is provided on the structure 42 for insuring adequate tension in the chain 58. The actual connection between this chain and the rollers 26 can take any convenient form.

It will be appreciated that the motor 44 can run continuously to drive the pinch rollers 60, 62 and three of the lower rollers 26 so that any lumber finding its way into contact with these rollers will be driven towards the end stop 30. If only a small end portion of a particular length of lumber is to be cut off by the saw 22, then the opposite end of the lumber will probably meet the swinging stop 32 nearest to the end structure 42. Similarly if the end portion to be removed is longer, then the opposite end of the corresponding piece of lumber will meet one of the other swinging stops 32. The structure of these stops and the method of positoning them relative to the saw 22 will not be described.

Figure 3:
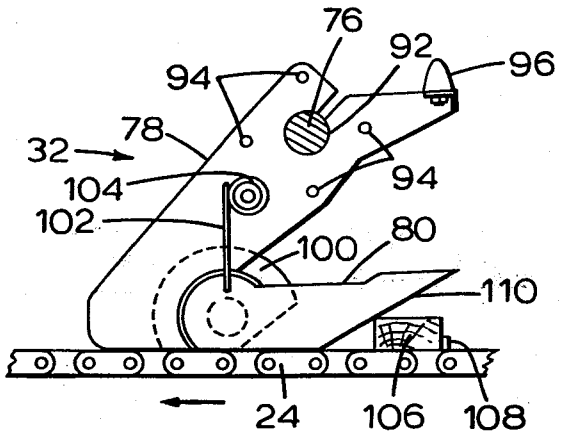
FIGS. 3 to 6 are side views of a swinging stop in four positions during the passage of a piece of lumber under the stop.

As seen in FIGS. 1 and 2, the swinging stops 32 are pivotally dependent from a threaded portion of an elongated support rod 76 which extends between the end structures 40, 42. FIG. 3 shows a typical swinging stop 32 having an upper portion 78 extending downwardly and pivotally coupled to a generally horizontal lower portion 80. The portion 78 is coupled to the support rod 76 (FIGS. 1 and 2) by a ball race 82 having its inner portion clamped by lock nuts 84, 86 to the support rod 76. The outer portion of the ball race is coupled by locking rings 88, 90 to the upper portion 78 concentrically relative to an opening 92 (FIG. 3) in the portion 78. Four small openings 94 spaced equally about the opening 92 receive bolts for attaching the locking rings 88, 90 to the upper portion 78.

Referring again to FIG. 3, the upper portion 78 includes a buffer 96 for engagement on the underside of an element 98 of the upper structure 38. The buffer 96 combines with this element to locate the swinging stop 32 in a rest position.

Figure 4:
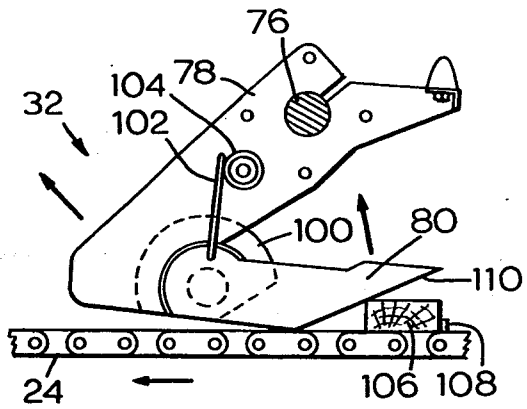
Figure 5:
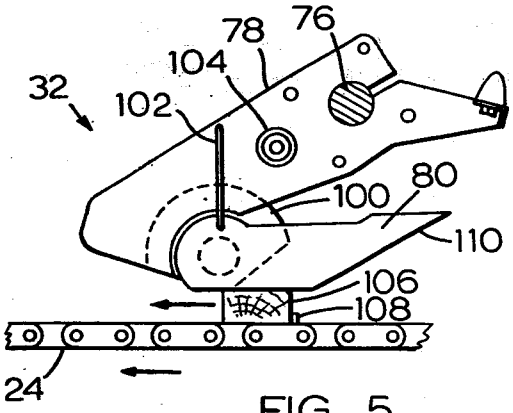

The lower portion 80 of the swinging stop 32 is pivotally connected to a relatively heavy slug 100 which is welded to the upper portion 78. The slug adds weight to bias the stop into the rest position and the arrangement permits a substantially planar front surface facing the viewer of FIG. 3 for engagement by the lumber as will be explained. The slug 100 is shaped to avoid interference with lumber passing under the stop when the lower portion 80 moves upwardly as will be described with reference to FIGS. 4 to 6. Downward movement of the lower porton 80 is limited by an upwardly extending arm 102 which engages a further buffer 104 on the front side of the upper portion 78. The buffer 104 and arm 102 combine to locate the lower portion 80 relative to the upper portion 78 with the swinging stop 32 in the rest position.

In the operation of the apparatus, lumber entering may have an end located anywhere between the end stop 30 (which corresponds to the maximum length of lumber to pass through the apparatus) and a position to the saw side of the swinging stop most remote from the end stop 30. In this latter positon, the pinch rollers 60, 62 will combine with the lower rollers 26 to drive the lumber into engagement with this particular swinging stop. The saw will then cut the lumber and the lumber will continue through the apparatus driven by the conveyors 24. However, if the lumber has an end aligned between any pair of swinging stops, then when the lumber is driven by the rollers towards end stop 30, an end of the lumber will move into engagement with one of the pair of stops nearest to the end stop 30. The other of the pair of stops will have to swing out of the way of the lumber as the lumber is driven past the saw and through the apparatus. This swinging action will now be described with reference to FIGS. 3 to 6 which show a swinging stop 32 in various positions as a piece of lumber 106 is driven past the stop by conveyors 24 which have lugs such as lug 108 to drive the lumber forwardly through the apparatus.

Figure 6:
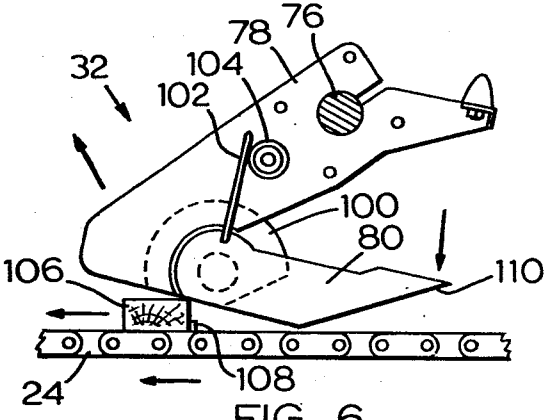

As seen in FIG. 3, the lower portion 80 has an overhanging inclined face 110 which is engaged by the lumber 106. This engagement causes the swinging stop 32 to initially pivot about a first axis defined by support rod 76 (FIG. 1). However, the inclined face 110 creates a force component tending to rotate the lower portion 80 upwardly about a second axis defined by its pivotal connection with the upper portion 78. A line joining the first and second axes defines an acute angle with the horizontal at a side of the stop facing incoming lumber. Consequently, after only a short movement into the position shown in FIG. 4, the lower portion 80 commences to pivot upwardly as indicated by an arrow in FIG. 4. This jack-knifing action continues until subsequently the lumber moves under the lower portion on contact with an underside of this portion with the swinging stop in the position shown in FIG. 5. It will be appreciated that the speed of operation of the machine depends upon the capacity for the swinging stop to return to an effective position for engaging another piece of lumber. To this end, as soon as the lumber passes below the pivotal connection between the portions of the stop 32, the weight of the stop bearing down on the lumber creates a turning moment in the lower portion 80 which rotates this portion back into its rest position relative to the portion 78 as indicated in FIG. 6. Consequently, the swinging stop can now engage an end of a piece of lumber if required and will continue to do so as the stop returns to its original rest position. The fully deflected position shown in FIG. 5 will depend upon the thickness of the piece of lumber.

It will be appreciated that the swinging stop 32 returns to an effective operative position faster than would a simple trailing arm. This is because a trailing arm must move completely out of the path of the lumber 106 before it can return to its original position whereas the present swinging stop can move into an effective position such as that shown in FIG. 6 relatively quickly and before the lumber has completely passed the swinging stop. This is of significance in the speed and effectiveness of the apparatus.

It will be appreciated that although a preferred embodiment of the apparatus has been described with reference to the drawings, various changes to the structure can be made within the scope of the invention. For instance, with suitable pinch rollers 60, 62 it may be found unnecessary to drive the rollers 26. Similarly, it may be possible with a suitable selection of materials to drive the lower rollers and not the pinch rollers. The arrangement of the support rod 76 and its connection to the swinging stops can also be modified consistent with the facility to adjust these stops.

What I claim is:

1. Apparatus for cutting unwanted end portions off lumber in the form of planks, studs and the like such that each of the remaining pieces of lumber is in one of several preferred lengths, the apparatus comprising:

a supporting framework;

a plurality of conveyors coupled to the framework and adapted to drive lumber sideways through the apparatus;

a saw coupled to an end of the apparatus and lying in a vertical plane parallel to the direction of movement of the conveyors and operable to cut lumber as the lumber is driven through the apparatus by the conveyors;

a drive mechanism operable to move the lumber longitudinally towards the other end of the apparatus before the lumber meets the saw; and swinging stops coupled to the framework for arcuate movement in planes parallel to said plane containing the saw, the swinging stops being adjustable to change the spacings between the stops and the saw according to said required preferred lengths, each of the swinging stops comprising: a first portion extending generally downwardly and mounted adjacent its upper end for pivotal movement about a first axis in a respective one of said planes; a second portion pivotally connected to the first portion adjacent a lower end of the first portion on a second axis parallel to the first axis, said axes being such that with the stop in a rest position a line joining said axes defines an acute angle with the horizontal at a side of the first portion facing incoming lumber, the second portion lying generally horizontally to stop lumber moving longitudinally and having an overhanging inclined face for engagement by incoming lumber which is to pass under the stop whereby lumber engaging this face causes the stop to swing upwardly and to jack-knife as said acute angle is reduced until the lumber passes under the stop in engagement with an underside of the second portion, and whereby as the lumber passes the second axis a turning moment is created in the second portion about the second axis to lower the second portion rapidly into a position for stopping lumber moving longitudinally in the apparatus.

2. Apparatus as claimed in claim 1 in which there are four such stops pivotally coupled to the framework.

3. Apparatus as claimed in claim 1 in which each said stop further comprises a buffer attached to the first portion for engagement with the framework to locate the stop in the rest position.

4. An apparatus for use in cutting unwanted end portions off lumber in the form of planks, studs and the like to trim the lumber into one of several lengths and including means for transporting the lumber sideways towards a saw, means for moving the lumber lengthwise before the lumber meets the saw and adjustable swinging stops arranged to locate an end of the lumber in a position such that after the saw cuts the lumber the resulting piece of lumber is in one of the said several lengths, the improvement in which the swinging stops are mounted for arcuate movement in planes parallel to a plane containing the saw, the swinging stops being adjustable to change the spacings between the stops and the saw according to said required preferred lengths, and each of the swinging stops comprising: a first portion extending generally downwardly and mounted adjacent its upper end for pivotal movement about a first axis in a respective one of said planes; a second portion pivotally connected to the first portion adjacent a lower end of the first portion on a second axis parallel to the first axis, said axes being such that with the stop in a rest position, a line joining said axes defines an acute angle with the horizontal at a side of the first portion facing incoming lumber, the second portion lying generally horizontally to stop lumber moving longitudinally and having an overhanging inclined face for engagement by incoming lumber which is to pass under the stop whereby lumber engaging this face causes the stop to swing upwardly and to jack-knife as said acute angle is reduced until the lumber passes under the stop in engagement with an underside of the second portion, and whereby as the lumber passes the second axis a turning moment is created in the second portion about the second axis to lower the second portion rapidly into a position for stopping lumber moving longitudinally in the apparatus.

5. For use in apparatus of the type used to trim unwanted end portions off lumber and having drive means adapted to move the lumber sideways through the apparatus past a saw which cuts off the unwanted end portions and means adapted to move the lumber longitudinally before the lumber meets the saw to locate one end of the lumber relative to the saw, a swinging stop for engagement by said one end of the lumber and moveable when engaged by a side of the lumber to permit the lumber to pass under the stop, the swinging stop being adapted to be mounted in the apparatus for arcuate movement in a plane parallel to a plane containing the saw, the swinging stop comprising: a first portion extending generally downwardly and adapted to be mounted adjacent its upper end to the apparatus for pivotal movement about a first axis in said plane; a second portion pivotally connected to the first portion adjacent a lower end of the first portion on a second axis parallel to the first axis, said axes being such that with the stop in a rest position, a line joining said axes defines an acute angle with the horizontal at a side of the first portion facing incoming lumber, the second portion lying generally horizontally to stop lumber moving longitudinally and having an overhanging inclined face for engagement by incoming lumber which is to pass under the stop whereby lumber engaging this face causes the stop to swing upwardly and to jack-knife as said acute angle is reduced until the lumber passes under the stop in engagement with an underside of the second portion, and whereby as the lumber passes the second axis a turning moment is created in the second portion about the second axis to lower the second portion rapidly into a position for stopping lumber moving longitudinally in the apparatus.

* * * * *